US006070757A

United States Patent [19]

Detherow

[11] Patent Number: 6,070,757

[45] Date of Patent: Jun. 6, 2000

[54] CHECK-OPERATED DISPENSER OF HOT SNACK STUFFS

[76] Inventor: Bobby L. Detherow, 3318 S. Elmira, Springfield, Mo. 65807

[21] Appl. No.: 09/206,496

[22] Filed: Dec. 7, 1998

Related U.S. Application Data

[60] Provisional application No. 60/067,999, Dec. 8, 1997.

[51] Int. Cl.[7] ..... A24F 27/14; B65D 83/00; G07F 11/72; G07F 11/00; A47F 1/04

[52] U.S. Cl. ..... 221/150 A; 221/155

[58] Field of Search ..... 221/150 A, 155, 221/265, 266

[56] References Cited

U.S. PATENT DOCUMENTS

| | | | |
|---|---|---|---|
| D. 316,276 | 4/1991 | Weiner | D20/3 |
| D. 331,997 | 12/1992 | Nottingham et al. | D99/30 |
| D. 333,681 | 3/1993 | Stern | D20/7 |
| D. 370,236 | 5/1996 | Stockman | D20/7 |
| 1,425,531 | 8/1922 | Mabey | 221/150 A X |
| 3,710,978 | 1/1973 | Cosby | 221/150 A |
| 4,324,059 | 4/1982 | Baum | 40/416 |
| 4,446,957 | 5/1984 | Dohse et al. | 194/54 |
| 4,526,292 | 7/1985 | Waxman | 221/150 A X |
| 4,560,086 | 12/1985 | Stol | 221/24 |
| 4,667,848 | 5/1987 | Gold | 221/155 |
| 5,004,122 | 4/1991 | Poynter | 221/155 |
| 5,163,356 | 11/1992 | Chigira | 221/150 A |
| 5,193,901 | 3/1993 | Stone | 362/32 |
| 5,197,793 | 3/1993 | Stone | 362/32 |
| 5,261,564 | 11/1993 | Yelvington | 221/113 |
| 5,310,084 | 5/1994 | Pittman | 221/150 A X |
| 5,385,267 | 1/1995 | Diamond et al. | 221/248 |
| 5,443,179 | 8/1995 | Palmer et al. | 221/265 |
| 5,452,822 | 9/1995 | Haymond | 221/155 |

*Primary Examiner*—Christopher P. Ellis
*Assistant Examiner*—Gene O. Crawford
*Attorney, Agent, or Firm*—Jonathan A. Bay

[57] ABSTRACT

A check-operated dispenser machine of hot snack stuffs includes a globe which in use contains a snack stuff such as for sake of an example, peanuts or other comparable nut or seed meats. The globe rests on a stand. The stand is modified from what is conventional in prior art gumball banks or other prior art check-operated dispensing machines of candies or novelties in that, such a prior art machine is modified to include a heat source. Most simply the heat source is configured as a low-wattage incandescent lamp bulb. The lamp warms the snack stuff contents in the globe. The dispensing machine has a conventional check- (eg., coin-) operated dispensing mechanism which allows a patron to serve him or herself and get a measured amount, such as about a hand-full, of such a snack stuff as say hot peanuts.

10 Claims, 3 Drawing Sheets

CHECK-OPERATED DISPENSER OF HOT SNACK STUFFS

CROSS-REFERENCE TO PROVISIONAL APPLICATION(S)

This application claims the benefit of U.S. Provisional Application Ser. No. 60/067,999, filed Dec. 8, 1997.

BACKGROUND AND SUMMARY OF THE INVENTION

The invention relates to check-operated dispensers of snack stuffs or novelties like coin- or slug-operated gumball machines. More particularly, the invention relates to check-operated dispensers of snack stuffs or novelties modified to serve hot snack stuffs including without limitation hot peanuts and so on.

The prior art is provided with an ample variety of gumball banks. Such gumball banks are characterized in having a globe-type "sight glass" reservoir for the gumballs (or other like candies) as well as a coin-operated dispensing mechanism which when a fed a coin and manually cranked, forthwith dispenses the gumball(s). Typical examples include U.S. Pat. No. 4,446,957—Dohse et al., U.S. Pat. No. 5,443,179—Palmer et al., U.S. Pat. No. 4,667,848—Gold, or U.S. Pat. No. 5,452,822—Haymond. Additionally, typical U.S. design patents include what is shown by Des. No. 316,276—Weiner, Des. No. 331,997—Nottingham et al., Des. No. 333,681—Stern, Des. No. 370,236—Stockman, and so on.

Of the foregoing referenced patents, the ones most pertinent for purposes allowing the inventive modifications to serve as contemplated by the present invention include the disclosures of Palmer, Gold, Stem and Stockman; or more marginally so, Dohse, Haymond and Weiner.

The group consisting at least of Palmer, Gold, Stem and Stockman all disclose globe-type "sight-glass" reservoirs. These reservoirs typically are assemblies comprising a globe, a detachable cap, and bottom or "bezel" therefor which might be alternatively cup- or dish- or even pan-like in shape. In contrast, the reference of Dohse for example discloses a "baseball" style reservoir which lacks a cap and also appears to lack detachable bottom portion. Regardless, each of at least Dohse, Palmer, Gold, Stem and Stockman will readily accommodate the modifications in accordance with the invention. Such modifications in accordance with the invention include, according to one example of the invention, the provision of a lamp below the globe-type reservoir, the heat from which will provide warmth to the snack stuff contents of the reservoir, as will be more particularly described below. In other words, there is a given "aspect ratio" between the area of a bottom portion (whether separable or not, and whether cup-, dish- or pan-like or whatever) of the reservoir and the volume of the reservoir that ought to be sufficient so that warmth to the bottom will be sufficiently transferred into the reservoir to achieve the desired quantum of warmth in the contents of the reservoir. To look at an example in which the aspect ratio between the measure of the bottom area and the measure of the reservoir volume is too small, is probably to look at the reference of Nottingham. The Nottingham reservoir has a rather narrow, elongated rectangular bottom relative to a substantially high and slender, columnar volume. It is believed that providing low-wattage warming power to such a relatively small bottom is unlikely to sufficiently warm the contents of the reservoir if filled with snack stuffs such as peanuts or similar nut or seed meats.

As mentioned above, the references of Dohse, Haymond and Weiner are relatively more marginally pertinent for purposes of the present invention—not because they have features which detract from incorporation into the present invention, but—because Dohse and Haymond and Weiner include design enhancements which while desirable as design enhancements are also surplusage if too costly to procure. More specifically, the Dohse reference discloses a globe styled as a baseball. The Haymond reference discloses a globe and dispensing mechanism supported high on top of a long spiral chute. The long spiral chute provides visual entertainment as the dispensed gumball rolls spiraling down the chute for ultimate discharge out an outlet. In Weiner, the base stand of the gumball bank is configured as a locomotive. Whereas the locomotive shape of Weiner or the baseball of Dohse are undoubtedly aesthetically pleasing, if one of the minor objects of the invention is to provide the invention in an inexpensive package (without, needless to say, sacrificing durability), then the baseball or locomotive design may simply be excessively costly to produce or procure under the circumstances of the market demand therefor.

To turn to matters concerning terminology, the globe-type "sight glass" reservoirs of the prior art (and such as would be suitable for adoption in the present invention) are not always strictly "globes" nor glass. Several of the references disclose globe-type reservoir shapes which are alternatively partial spheres, pot-bellied, or cylindrical, or have other nonspherical shapes including hourglass figures or boxes with corners. Hence use of the terms "globe(s)," globe-type" and so on by the inventor hereof includes such variety of shapes as well. Also, the reservoirs of the prior art are variously glass or plastic. Such materials as including without limitation glass and plastic are equally suitable for incorporation and use in the globe or reservoir of the check-operated dispenser of hot snack stuffs in accordance with the invention. It is most often true that the globes or reservoirs are transparent. Transparency is not so much a functional requirement as a custom of the industry for allowing patrons of the gumball banks to see what the offerings are. The inventor hereof likewise prefers that his reservoir of his inventive check-operated dispenser of hot snack stuffs also be transparent in accordance with custom, but not to the exclusion of also incorporating translucent or even opaque reservoirs. The reference of Dohse seems to disclose an opaque reservoir (ie., an enlarged scale hollow baseball). "Check" is a term of art in the industry relating to the prior art gumball banks and the like. The term "check" includes coins in the sense that the dispensing mechanisms thereof are most typically "coin-operated" when instead referenced under the rubric of "check-operated." A dictionary definition of "check" includes among others "a sample or unit used for testing or verifying" a standard or criterion. Webster's Ninth New Collegiate Dictionary (Merriam-Webster 1990). The inventor hereof adopts and uses the term "check" in accordance with both its term-of-art and dictionary meanings and without knowledge of inconsistencies therebetween, including at minimum its meanings indicating coin-, token- or currency-operated dispensing mechanisms.

The patent disclosures referenced above are concerned in major sense with the dispensing of gumballs, and merely at ambient (eg., the local surrounding indoor or outdoor environmental) temperature. The invention on the contrary, is concerned in a major sense with the dispensing of warmed or "hot" (as that term is more particularly explained below) snack stuffs which include without limitation (but most preferably) such snack stuffs as peanuts and like nut or seed meats. The prior art is known to include globe-type, coin-operated dispensing machines which are comparable to the gumball banks disclosed by the referenced patents, but which disclose other types of candies and/or novelties. The modifications of the present invention for converting a gumball machine in accordance with the prior art into a check-operated dispenser of hot snack stuffs in accordance with the invention, could be executed without limitation on such other suitable types of prior art globe-type, coin-operated dispensing machines. One aspect of the invention includes the simple expediency of procuring a readily available, off-the-shelf prior art globe-type, check-operated dispensing machine and modifying and/or converting it into a check-operated dispenser of hot snack stuffs in accordance with the invention. Such modifications and/or conversion include without limitation the provision of a heat source to warm the contents of the globe, as will be more particularly described below.

These and other aspects and objects are provided according to the invention in a check-operated dispensing machine of hot snack stuffs that has a globe which in use contains a snack stuff such as including without limitation peanuts or other comparable nut or seed meats. The globe rests on a stand. The stand is modified from what is conventional in prior art gumball banks or other prior art check-operated dispensing machines candies or novelties in that, the prior art machine is modified to include a heat source such as by way of non-limiting example, an incandescent lamp bulb. The lamp warms the snack stuff contents in the globe. The dispensing machine has a conventional check- (eg., coin-) operated dispensing mechanism which allows a patron to serve him or herself and get a measured amount, or about a hand-full, of such as snack stuff as say hot peanuts.

Additional aspects and objects of the invention will be apparent in connection with the discussion further below of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
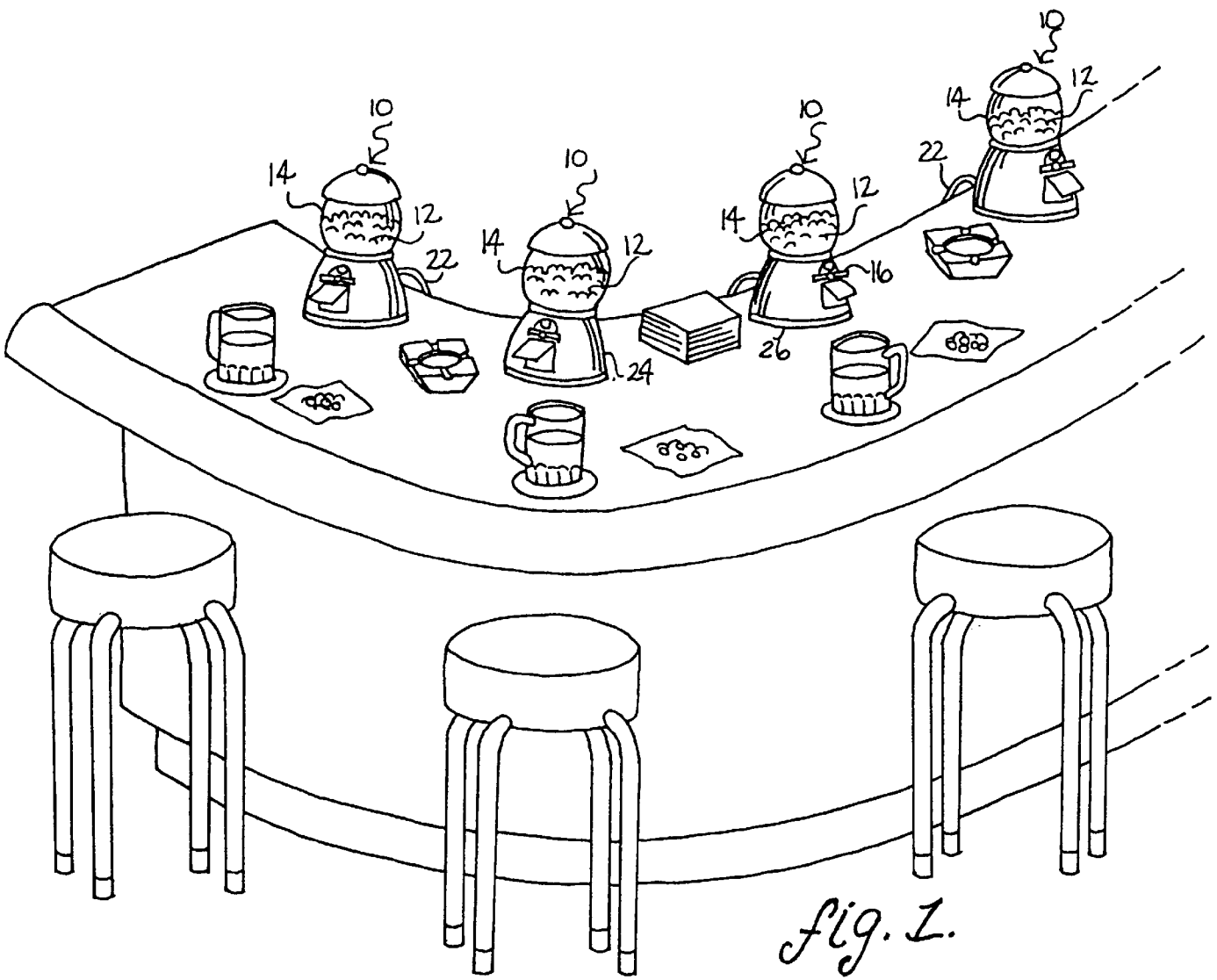
FIG. 1 is a perspective view of several check-operated dispensing machines of hot snack stuffs in accordance with the invention, as shown distributed around the countertop of a bar or beverage service establishment to illustrate one operative use environment therefor.

FIG. 1 shows several check-operated dispensing machines 10 of hot snack stuffs (indicated as 12 in the drawings) in accordance with the invention, as illustrated distributed around the counter-top of a bar or beverage service establishment to depict one example operative use environment therefor.

Each dispensing machine 10 has a globe 14 reservoir preferably made from transparent glass or plastic to serve as a "sight glass" of the contents 12 thereof, and hence show-case the contents 12 to attract purchase by customers. The globes 14 as shown contain peanuts 12, although other snack stuffs can be substituted for the peanuts 12 especially snack stuffs which are desirably served warm such as by way of non-limiting example other kinds of nut and seed meats and the like. The dispensing machine 10 has a check-operated dispensing mechanism 16 which is conventional and is manually turned and hence requires no external power source. The heat source (not in view, but indicated as 20 in FIGS. 3 and 4) that gives warmth to the peanut 12 contents of the globe 14, however, requires a feed of external power. Accordingly, each machine 10 includes a line cord 22 for plug-in to a wall socket (not shown) of public-utility supplied power.

A finding of the inventor hereof which is supported by trial installations of the hot peanuts version 10 of the invention, includes that it is especially popular with patrons of bars or like beverage serving establishments. It has long been known that adding a little heat to peanuts to warm them up enhances their flavor. Installations 10 in bars apparently are drained of peanuts by patrons much faster than elsewhere and require more frequent re-supplying service.

The inventor hereof uses the term "hot" in a relative sense to mean that the given snack stuff 12 is served at some temperature warmer than room temperature. The snack stuffs 12 are served only at moderately elevated temperatures and are certainly sufficiently cool to hold without discomfort in one's hand and consume immediately after dispensing by the machine 10.

Figure 3:
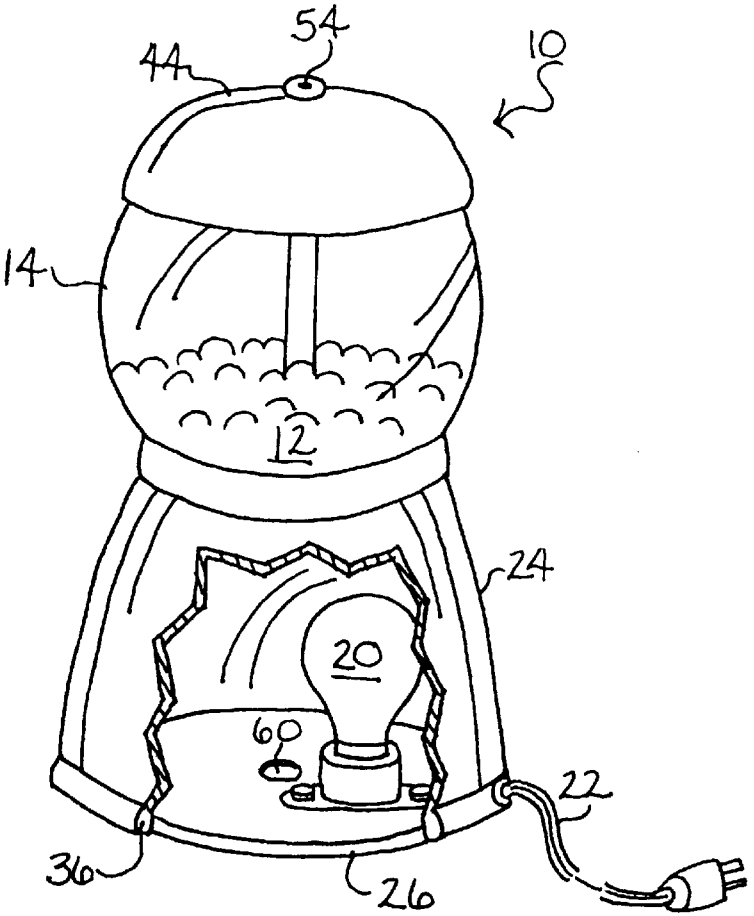
FIG. 3 is a perspective view comparable to FIG. 2 except of the opposite (or back) side thereof, wherein portions of the skirt of the stand are broken away from the view to reveal an enclosed incandescent lamp bulb within; and, FIG. 4 is an exploded perspective view thereof, with portions common to conventional check-operated machines not shown for purposes of clarity.
Figure 2:
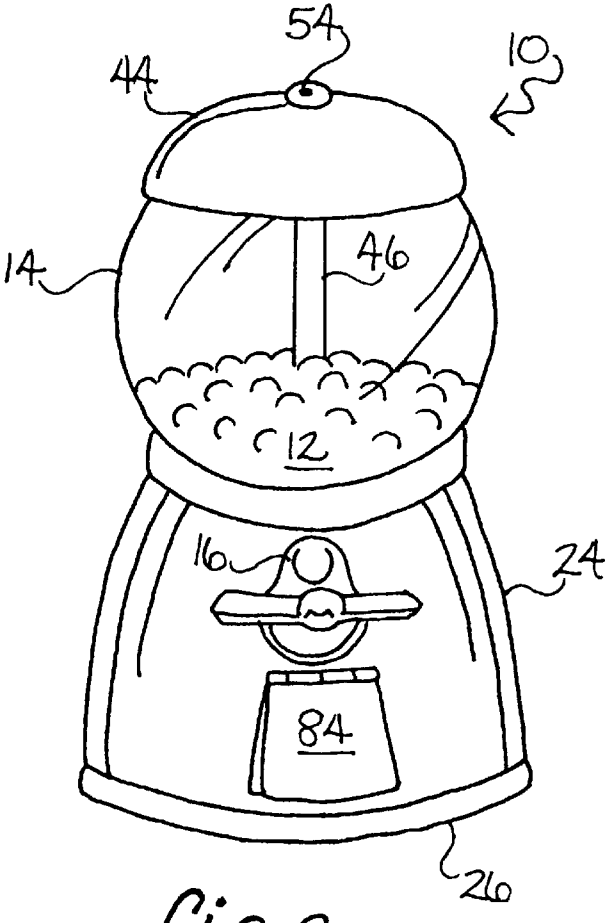
FIG. 2 is an enlarged perspective view of one of the check-operated dispensing machines of hot snack stuffs of FIG. 1, as shown in isolation in this view.
Figure 4:
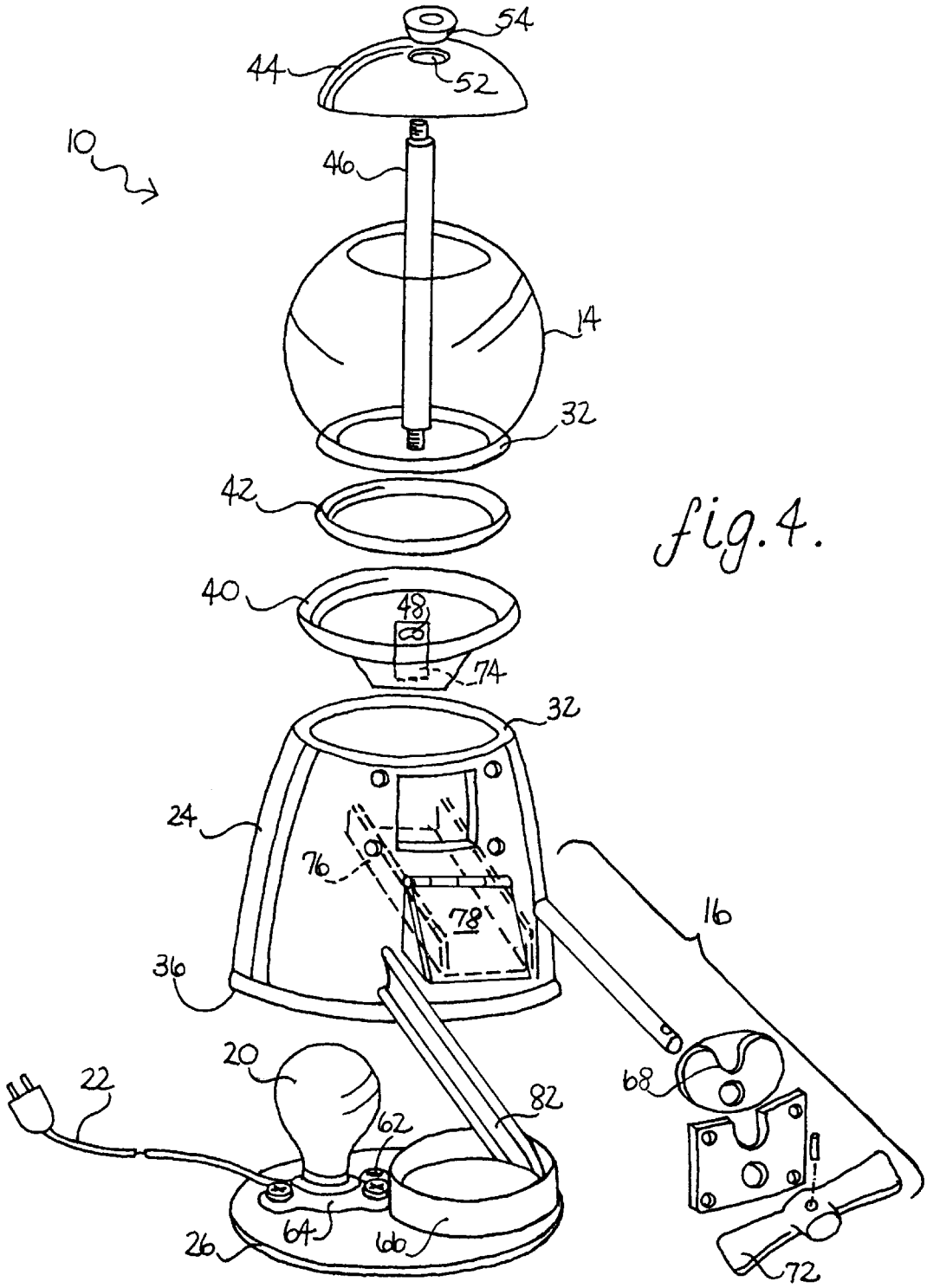

With general reference to FIGS. 2 through 4, the check-operated dispensing machine 10 in accordance with the invention comprises the globe 14 mounted on a stand 24 which is substantially hollow and flares out like a skirt to rest on a base plate 26. The globe 14 generally has the shape of a hollow sphere formed with upper and lower holes. However, since the globe 14 merely serves as a reservoir, it hence can take other shapes including without limitation, cylindrical, conic, pot-bellied, hourglass or box shapes and the like. In the drawings, the globe is shown such that its lower hole is formed with a peripheral flange 32.

With particular reference to FIG. 4, the skirt-like stand 24 extends vertically between an upper collar 34 and a lower edge 36. The upper collar 34 provides a mounting surface for a bezel 40. The bezel 40 functions as a bottom for the globe 14. After assembly, the bezel 40 is affixed enclosed within the confines of the skirt-like stand 24, mounted to the underside of the collar 34. The collar 34 has an upper surface which functions a seat for a gasket 42. After assembly, the gasket 42 is sandwiched between the collar/seat 34 of the stand 24 and the peripheral flange 32 of the globe 14.

Assembly of the globe 14 to the stand 24 is accomplished by a clamping arrangement between a spherical cap 44 and the stand collar 34 vis-a-vis a tension rod 46 extending between the spherical cap 44 and bezel 40. The tension rod 46 has opposite ends formed with screw thread. The bezel 40 includes a fixed nut 48 welded or otherwise sufficiently secured thereto, and aligned on the central vertical axis of symmetry thereof. The fixed nut 48 is adapted for receiving the lower screw-thread end of the tension rod 46. The cap 44 includes a tapered socket 52 adapted for partial insertion of a key-actuated threaded-nut 54 (the key to turn the threaded-nut 54 is not shown). Inclusion of the key-actuated threaded-nut 54 is conventional and prevents unauthorized entry to persons not authorized to posses a key therefor.

In use, the bezel 40 is affixed hanging down from the collar 34 of the skirt-like stand 24. The tension rod 46's lower threaded-end is twisted into the bezel's nut 48 and extends upright therefrom. The gasket 42 is seated on the collar 34. The globe 14' peripheral flange 32 is seated on the gasket 42 and collar 34. The cap 52 is place covering over the upper hole of the globe 14. The key-actuated threaded-nut 54—by use of the key therefor (not shown)—is twisted onto the tension rod 46's upper threaded end until the globe 14 is sufficiently compressed between the cap 44 and collar 34. Filling and re-filling of the globe 14 with snack stuffs 12 is achieved through the globe 14's open top end after removal of the cap 44.

With renewed reference to FIG. 4, the skirt-like stand 24's lower edge 36 is removably attachable to the base plate 26. The base plate 26, like the cap 44, also includes a central tapered socket (indicated as 60 in FIG. 3) for removable insertion of a key-actuated safety-nut (indicated as 62 in FIG. 4, and, e.g., comparable or identical to safety-nut 54 of the top cap 44). The safety nut 62 that secures the base plate 26 to the skirt-like stand 24 screws onto a stud (not shown) for it affixed to the skirt-like stand 24 by a cross bar (also not shown) spanning diametrically across the lower edge 36 of the stand 24. In this way, access to the interior of the stand 24 is therefore limited to authorized persons possessing a key for safety nut 62. The base plate 26 provides a mounting surface for a lamp socket 64 and a coin tray 66. Hence, in general, it is useful to limit access to the coin tray 66 by means of the safety nut 62 in order to prevent unauthorized persons from removing the coinage therein.

The skirt-like stand 24 carries the check-, coin- or slug-operated dispensing mechanism 16. There are at least three varieties of check-operated dispensing mechanisms disclosed by various prior art patents to be referenced immediately nest, which are suitable for incorporation into the invention as where indicated as 16 in the drawings. More particularly, check-operated mechanism 16 is a revolving crank-type mechanism which is shown at least by the U.S. Patent disclosures of U.S. Pat. No. 4,667,848—Gold, U.S. Pat. No. 5,004,122—Poynter, U.S. Pat. No. 5,452,822—Haymond, Des. No. 316,276—Weiner, Des. No. 331,997—Nottingham et al., Des. No. 333,681—Stem, Des. No. 370,236—Stockman, and so on, the disclosures of which are incorporated herein fully by this reference thereto.

The check-operated mechanism 16 utilized by the invention may alternatively be of a type having a transversely-sliding lever actuated action as disclosed by U.S. Pat. No. 4,446,957—Dohse et al., or U.S. Pat. No. 5,443,179—Palmer et al. Additionally, the check-operated mechanism 16 may be configured equivalent to a "Monarch" type style (e.g., sled-type) as disclosed by U.S. Pat. No. 5,261,564—Yelvington. All the foregoing disclosures are alike incorporated herein fully by this reference.

However, it is noted that the revolving-crank type mechanism (eg., as actually depicted in the drawings including FIG. 4), appears to be the most popular style for the relatively economically-priced gumball banks against which this invention will more nearly be priced to. On the other hand, use of the transversely-sliding lever actuator appears to be preferred for toys. Whereas, in the other direction, the monarch-type sled coin feed is used on high end vending machines. Hence cost considerations may dictate against practical incorporation of the sled-type into the invention. In consequence, the preferred type of dispensing mechanism for the invention is likely the revolving crank type as shown by the drawings (eg., indicated as 16).

In accordance with the above-incorporated disclosure(s), insertion of a coin (not shown) in a coin slot 68 of the mechanism 16, and then hand turning of the winged-crank 72 causes the coin to release a locking dog in the mechanism 16 (the dog is not shown) and thus allows a closure member inside (not shown) to drop a measured amount of snack stuff 12 out through an access hole 74 in the bezel 40 to slide down a ramp 76 therefor to a discharge outlet 78. Continued turning of the crank 72 deposits the coin in a chute 82 so it lands in the coin tray 66 therefor. FIG. 2 shows that the discharge outlet 78 is covered by a hinged flap 84.

Given the foregoing description of the check-operated mechanism 16, in this way a patron or customer can serve him or herself to a handful of hot snack stuffs 12 with a coin or the like.

An inventive aspect of the hot snack stuff machine relates to the inclusion of a heat source 20 for warming the snack stuff 12 contents of the globe 14. In the embodiment of the invention 10 disclosed by the drawings, the inventor hereof has used a lamp bulb 20. To date, trials have been performed with lamp bulbs in the 20- to 40-watt range, and have worked satisfactorily. In some of the trials the skirt-like stand 24 was formed from a plastic material, and such a lamp bulb 20 did not disfigure nor warp the plastic. At the same time, the peanut 12 contents of the globe 14 were indeed warmed up to an appropriate temperature. The "heat" or thermal emission given off by the lamp 20 is a mixture of at least radiation and a rising thermal plume impinging on the bezel 40 or other bottom portion of the globe 14 overhead.

In use the check-operated dispensing machine 10 for hot snack stuffs 12 and the like provides customers with an opportunity to serve themselves a hot snack stuff. It has been learned that a given snack stuff 12 such as peanuts has a measurable "shelf life." After so long a time in the globe 14, the peanuts 12 go stale, especially while being warmed by the bezel 40 over the lamp bulb 20. At the end of the given "shelf life," the unsold peanuts 12 in the globe 14 are discarded, and then the globe 14 is replenished with fresh peanuts. In this way the globe 14 is kept supplied with fresh, warm peanuts 12, unless of course the globe 14 is drained by patrons thereof before expiration of the targeted replacement (eg., "shelf") life.

A substantial aspect of the invention involves the procurement and production of the check-operated dispensing machines 10 in accordance with the invention. Whereas for gumball banks no doubt there exists a substantial retail market (ie., especially among children), the preferred market structure for the present machines 10 is more in the nature of a lease. That is, a typical owner of a bar or like beverage-serving service establishment is likely merely to lease a whole series of machines 10 for a portion of the revenues therefrom. Indeed this situation is illustrated by FIG. 1. The title owner of the machines is likely to contract with multiple business establishments in a given territory, and put his or her machines on the premises under a "portion of the revenues" type of arrangement.

In short, while the market for these machines 10 might promise much use by patrons of them for the hot snack stuffs, there also isn't likely to be market for selling these machines to the patrons, nor else the business owners. Accordingly, the market is likely to be adequately serviced by a relatively low total number of machines. Insufficient numbers or machines are likely to be produced to cost justify a production line for the machines 10 as designed and built from scratch, with custom molds and assembly for the whole structure.

Instead, the cost efficiency in producing the dispensing machines 10 in accordance with the invention—especially in the size to place on table or counter-tops—is preferably adequately met by procuring a readily available, off-the-shelf coin-operated gumball bank and then modifying it for service as a dispenser of hot snack stuffs 10 in accordance with the invention. Again, to date, a lucrative location for the dispensers of hot snack stuffs 10 is the counter-tops of bars or like beverage service establishments, a shown by FIG. 1. Therefore, the criteria of a suitable off-the-shelf coin-operated gumball bank for modifying in accordance with the invention include some of the following aspects. Foremost is, that any such candidate gumball bank be "counter-top sized."

The phraseology "counter-top sized" can be defined or reckoned various ways. For illustration's sake, FIG. 1 shows dispensers 10 which are appropriately counter-top sized. A sampling of prior art patent references likewise illustrate gumball banks which are appropriately counter-top sized. Their overall sized can be easily and sufficiently accurately reckoned or scaled by the size of the coin slots. A list follows of patent references which disclose suitable "counter-top sized" gumball banks, as well as the figure thereof which shows the coin slot therefor for feeding the manually-operated dispensing mechanism. That is, such a list may include U.S. Pat. No. 4,446,957—Dohse et al. (FIG. 1); U.S. Pat. No. 5,443,179—Palmer et al. (FIG. 1), U.S. Pat. No. 4,667,848—Gold (FIG. 1), Des. No. 316,276—Weiner (FIG. 5), and Des. No. 331,997—Nottingham et al. (FIG. 1).

On the other hand, prior art patent references which illustrate gumball machines which are not counter-top sized but floor stand sized include U.S. Pat. No. 5,452,822—Haymond (see, eg., FIG. 1), Des. No. 333,681—Stern (see, eg., FIG. 1), Des. No. 370,236—Stockman (see, eg., FIG. 1). These last three referenced patent are examples of gumball machines which are inappropriate insofar only as not being counter-top sized, although they could be modified into a floor stand model if desired of a dispenser of hot snacks in accordance with the invention.

The group consisting at least of Dohse, Palmer, Gold, Stem and Stockman all disclose suitable globe-type "sight-glass" reservoirs. These reservoirs typically are assemblies comprising a globe, a detachable cap, and bottom or "bezel" therefor which might be alternatively cup- or dish- or even pan-like in shape. However, the foregoing are only typical aspects of suitable globe-type "sight-glass" reservoirs and do not constitute a check-list of required criterion. Variations can be easily accommodated. For example, the reference of Dohse (as previously mentioned) discloses a "baseball" style reservoir which lacks a cap and also appears to lack detachable bottom portion. The Dohse reservoir hence only appears to have a reservoir provided with an opening in a bottom region thereof. It is also believed that some of these references may disclose "bezels" which are in fact inseparable from the base stands. Regardless of such variations, each of at least Dohse, Palmer, Gold, Stem and Stockman will readily accommodate the modifications in accordance with the invention. Such modifications in accordance with the invention include, according to one example of the invention, the provision of a lamp below the globe-type reservoir, the heat from which will provide warmth to the snack stuff contents of the reservoir, as will be more particularly described below.

As has been described above, one apparent distinguishing criterion for the "suitability" of any candidate globe-type reservoir relates to a given "aspect ratio" between the area of a bottom portion (whether separable or not, and whether cup-, dish- or pan-like or whatever) of the reservoir and the volume of the reservoir.

This aspect ration between the prospective heat-absorbing bottom area the reservoir volume ought to be sufficient so that warmth to the bottom will be sufficiently transmitted into the reservoir to achieve the desired quantum of warmth for the contents of the reservoir. To look at an example in which the aspect ratio between the measure of the bottom area and the measure of the reservoir volume is too small, is probably to look at the reference of Nottingham. The Nottingham reservoir has a rather narrow, elongated rectangular bottom relative to a substantially high and slender, columnar volume. It is believed that providing low-wattage warming power to such a relatively small bottom is unlikely to sufficiently warm the contents of the reservoir for the purposes of such snack stuffs such as peanuts or similar nut or seed meats.

Given a suitable globe-type reservoir according to the foregoing, then the method of converting such a readily available and off-the-shelf, counter-top sized gumball bank of the prior art into a check-operated dispenser of hot snack stuffs such as nut and seed meats, comprising very generally the following steps.

That is, the gumball bank is presumed to be of the type having a globe-type "sight-glass" reservoir. It at least includes a bottom portion and an opening therein. The gumball bank also at least includes a stand. The stand might typically include a base, a sidewall-type configuration extending up from the base, and a given relatively upper mounting arrangement for mounting the globe by the bottom portion thereof. Also the gumball machine ought to include a built-in check-operated dispensing mechanism. This dispensing mechanism it typically mounted to the stand at least partly to the sidewall-type configuration thereof. The dispensing mechanisms is likely to include a discharge outlet for discharge of dispensed gumballs. Naturally enough such a dispensing mechanism operably interconnects the opening in the bottom portion of the globe with the discharge outlet such that a patron feeding the dispensing mechanism a suitable coin (or "check") can serve him or herself to dispensation of gumballs from the globe.

In the production work of modifying the prior art gumball bank, a worker preferably disassembles the stand vis-a-vis at least disassembling the base from the stand, or the dispensing mechanism from the sidewall of the stand, or the globe from the top of the stand, or however it is that the stand is opened up. The worker then installs one or more lamp sockets inside the stand. The lamp sockets should be placed at locations generally below the given mounting arrangement for the globe. As shown by FIGS. 3 and 4, the single lamp socket 64 depicted thereby shows it affixed to the base plate 26. The worker then provides an access in the stand for the extension of a line cord 22 (see, eg., FIG. 3 and the line-cord nut for the cord 22). The socket 64 is wired routinely to the line cord 22 for electrical hook-up of the lamp 20 to a socket to public-utility supplied power. After having plugged in the lamp, the worker can reassemble the stand and as a result, an ordinarily skilled worker has hence converted a gumball bank of the prior art into a dispenser 10 in accordance with the invention use for dispensing such warm snack stuffs 12 as including warm nut and seed meats.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A counter-top sized, check-operated gumball bank modified for check-operated dispensing of loose, unpackaged hot nut or seed meats, comprising:

a removably-clamped hot reservoir essentially comprising an open-bottomed "sight-glass"

a stand providing for the removable clamping thereto of the hat reservoir, the stand including a hat bezel for mating the removably-clamped hot reservoir and defining a bottom therefor, a generally continuous sidewall arrangement extending between a lower border and an upper seat for seating one of the hot bezel or reservoir thereon, and a lower closure portion mated proximately to the sidewall's lower border wherein said hat bezel, sidewall arrangement and lower closure portion cooperatively define a substantially enclosed compartment immediately below the removably-clamped hot reservoir;

a check-operated dispensing mechanism mounted to the stand substantially inside the enclosed compartment thereof and including a discharge outlet for discharge of dispensed hot nut or seed meats externally of the stand;

wherein the hot bezel and reservoir cooperatively combine to provide hot storage of a supply of the loose, unpackaged hot nut or seed meats, and also to feed the dispensing mechanism; which said dispensing mechanism operably interconnects one of the hot bezel or reservoir with the discharge outlet such that feeding the dispensing mechanism a suitable check allows a patron to serve him or herself to dispensation of a measured amount of the loose, unpackaged hot nut or seed meats from the reservoir;

a lamp socket mounted to the stand and proximately inside said enclosed compartment thereof such that the lamp socket is located underneath the hit bezel that defines the bottom of the hot reservoir;

a line cord for connecting the lamp socket to a suitable source of electric power;

an incandescent lamp inserted in the lamp socket and disposed substantially inside the enclosed compartment of the stand, as located underneath the hot bezel for warming substantially most of the hot reservoirs contents by means of radiant heat as well as rising convective thermal currents impinging the hot bezel if not also leaking thereby and into the hot reservoir, wherein said gumball bank is hence modified for use for dispensing such loose, unpackaged hot nut and seed meats; and, clamping means for removably clamping and un-clamping the hot reservoir to or from the hot bezel such that un-clamping the hot reservoir following periods of use for warming loose, unpackaged hot nut or seed meats allows removal of the globe remote from said stand as for washing or sanitizing.

2. The counter-top sized, check-operated gumball bank modified for check-operated dispensing of loose, unpackaged hot nut or seed meats of claim 1 wherein the globe is produced from one of glass and plastic material.

3. The counter-top sized, check- operated gumball bank modified for check-operated dispensing of loose, unpackaged hot nut or seed meats of claim 1 wherein the dispensing mechanism includes an actuator comprising one of a revolving crank, a transversely-sliding lever, and a sled.

4. The counter-top sized, check-operated gumball bank modified for check-operated dispensing of loose, unpackaged hot nut or seed meats of claim 1 wherein the lamp is chosen from a low-wattage variety of about no more than 40 watts.

5. A check-operated dispenser of loose, unpackaged hot nut or seed meats, comprising:

a removably-clamped hot reservoir essentially comprising an open-bottomed "sight-glass" globe;

a stand providing for the removable clamping thereto of the hot reservoir, said stand having a generally continuous sidewall arrangement extending between a lower border and an upper given mounting arrangement for the hot reservoir such that the bottom portion of the hot reservoir is situated on the given mounting arrangement, and also having a lower closure portion mated proximately to the lower border such that the continuous sidewall arrangement and lower closure portion cooperatively define a generally enclosed, open-topped compartment;

a check-operated dispensing mechanism mounted to the stand substantially within the open-topped compartment, which check-operated dispensing mechanism incorporates a hot bezel for mating one of the opening in the bottom portion of the reservoir or the stand's upper mounting arrangement such that the hot bezel with the stand's upper mounting arrangement defines an upper closure for the open-topped compartment and that the hot bezel with the hot reservoir cooperatively combine to provide hot storage of a supply of the loose, unpackaged hot nut or seed meats, wherein said check-operated dispensing mechanism further includes a discharge outlet for discharge of dispensed snack stuffs externally of the stand, wherein the check-operated dispensing mechanism is arranged to operably interconnect the opening in the bottom portion of the reservoir with the discharge outlet such that a patron by feeding the dispensing mechanism a suitable check can serve him or herself to dispensation of a measured amount of snack stuffs from the reservoir;

at least one lamp socket mounted to the stand proximately inside the compartment in the stand and underneath the hot bezel as well as the hot reservoir;

a line cord for connecting the at least one lamp socket to a suitable source of electric power;

at least one incandescent lamp inserted in the at least one lamp socket and as located substantially within the compartment of the stand and immediately underneath the hot bezel as well as the hot reservoir such that radiant heat and rising thermal currents given off by the lamp impinge the bezel, dispensing mechanism and upper mounting arrangement as well as leak thereby into the reservoir for accomplishing warming substantially most of the hot reservoirs contents wherein said loose, unpackaged nut or seed meats are dispensed hot in measured amounts; and, clamping means for removably clamping and un-clamping the hot reservoir such that unclamping the hot reservoir following periods of use for warming loose, unpackaged hot nut or seed meats allows removal of the globe remote from said stand as for washing or sanitizing.

6. The check-operated dispenser of claim 5 wherein the dispensing mechanism includes an actuator comprising one of a revolving crank, a transversely-sliding lever, and a sled.

7. The check-operated dispenser of claim 5 wherein the collective wattage of the at least one lamp and others, if any, is limited to about 40 watts and less.

8. The check-operated dispenser of claim 5 wherein the stand is produced generally from plastic materials.

9. The check-operated dispenser of claim 5 wherein the reservoir includes a globe portion produced from one of glass and plastic material.

10. The check-operated dispenser of claim 9 wherein the globe portion is furthermore produced from one of transparent, translucent and opaque material.

* * * * *